US009390682B2

(12) United States Patent
Hadas

(10) Patent No.: US 9,390,682 B2
(45) Date of Patent: Jul. 12, 2016

(54) ADJUSTMENT OF DISPLAY INTENSITY

(71) Applicant: EMPIRE TECHNOLOGY DEVELOPMENT LLC, Wilmington, DE (US)

(72) Inventor: Noam Hadas, Tel-Aviv (IL)

(73) Assignee: Empire Technology Development LLC, Wilmington, DE (US)

( * ) Notice: Subject to any disclaimer, the term of this patent is extended or adjusted under 35 U.S.C. 154(b) by 142 days.

(21) Appl. No.: 14/232,172

(22) PCT Filed: May 16, 2013

(86) PCT No.: PCT/US2013/041383

§ 371 (c)(1),
(2) Date: Jan. 10, 2014

(87) PCT Pub. No.: WO2014/185919

PCT Pub. Date: Nov. 20, 2014

(65) Prior Publication Data

US 2015/0269907 A1 Sep. 24, 2015

(51) Int. Cl.

| | |
|---|---|
| ***G09G 5/10*** | (2006.01) |
| ***G09G 3/30*** | (2006.01) |
| ***G09G 5/36*** | (2006.01) |

(52) U.S. Cl.

CPC .. *G09G 5/10* (2013.01); *G09G 3/30* (2013.01); *G09G 5/363* (2013.01); *G09G 2320/0626* (2013.01); *G09G 2320/0686* (2013.01); *G09G 2330/021* (2013.01)

(58) Field of Classification Search

CPC ..... G09G 5/10; G09G 2320/0233; G09G 2320/0626; H04N 5/57

See application file for complete search history.

(56) References Cited

U.S. PATENT DOCUMENTS 7,744,216 B1 * 6/2010 Uhlhorn ..... 351/204
7,878,549 B2 2/2011 Simske et al.

(Continued)

FOREIGN PATENT DOCUMENTS

JP 11101935 A 4/1999
WO 2007139656 A2 12/2007

OTHER PUBLICATIONS

International Search Report and Written Opinion for PCT application with application No. PCT/US13/41383, dated Nov. 22, 2013, 29 pages.

(Continued)

*Primary Examiner* — Antonio A Caschera

(74) *Attorney, Agent, or Firm* — Moritt Hock & Hamroff LLP; Steven S. Rubin, Esq.

(57) ABSTRACT

Methods and systems effective to implement adjusting of display intensity are described. In some examples, a processor may receive display instructions. The display instructions may include instructions that relate to display of first output data. The first output data may be effective to produce a first intensity when rendered by a display. The processor may apply a technique at a first level to the display instructions to generate second output data. The second output data may be effective to produce a second intensity when rendered by the display. The second intensity may be less than the first intensity. The processor may apply the technique at a second level to the display instructions to generate third output data. The third output data may be effective to produce a third intensity when rendered by the display. The third intensity may be less than the second intensity.

20 Claims, 7 Drawing Sheets

(56) References Cited

U.S. PATENT DOCUMENTS

| | | | | |
|---|---|---|---|---|
| 8,378,960 | B2 * | 2/2013 | Kangas et al. | 345/102 |
| 8,411,098 | B2 * | 4/2013 | Harris et al. | 345/581 |
| 2005/0156949 | A1 | 7/2005 | Tsou | |
| 2007/0273714 | A1 * | 11/2007 | Hodge et al. | 345/690 |
| 2009/0290326 | A1 | 11/2009 | Tiedje et al. | |
| 2010/0007601 | A1 | 1/2010 | Lashina et al. | |
| 2011/0080422 | A1 | 4/2011 | Lee et al. | |
| 2012/0306768 | A1 | 12/2012 | Bailey | |
| 2013/0082991 | A1 | 4/2013 | Lin | |

OTHER PUBLICATIONS

Kamijoh, N. et al., "Energy trade-offs in the IBM Wristwatch computer", ISWC, EEE Computer Society, 2001, p. 133-140.

Iyer, S. et al., "Energy-Adaptive Display System Designs for Future Mobile Environments", the Proceedings of the The First International Conference on Mobile Systems, Applications, and Services, May 5-8, 2003, 10 pages.

Wee, T. K. & R. K. Balan, "Adaptive Display Power Management for OLED Displays", MobiGames'12, Aug. 13, 2012, p. 25-30.

Dong, M & L. Zhong, "Chameleon: A Color-Adaptive Web Browser for Mobile OLED Displays", MobiSys '11 Proceedings of the 9th international conference on Mobile systems, applications, and services, 2011, pp. 85-98.

Lai, Y. K. et al., Content-Based LCD Backlight Power Reduction With Image Contrast Enhancement using Histogram Analysis, Journal of Display Technology, Oct. 2011, p. 550-555.

Han, K. et al., "Using checksum to reduce power consumption of display systems for low-motion content", IEEE International Conference on Computer Design, 2009, p. 47-53.

Mokwena, K. K., "Ethylene Vinyl Alcohol: A Review of Barrier Properties for Packaging Shelf Stable Foods" Critical Reviews in Food Science and Nutrition, 2012, 640-650.

* cited by examiner

ADJUSTMENT OF DISPLAY INTENSITY

CROSS REFERENCE TO RELATED APPLICATIONS APPLICATION

This application is the National Stage filing under 35 U.S.C. §371 of International Application No. PCT/US13/41383 filed May 16, 2013. The disclosure of the International Application is hereby incorporated by reference in its entirety.

BACKGROUND

Unless otherwise indicated herein, the materials described in this section are not prior art to the claims in this application and are not admitted to be prior art by inclusion in this section.

Devices such as mobile phones may include a processor and a display. The processor may receive and execute display instruction to generate output data. The display may be used to render the output data to produce images and/or text. Rendering images and/or text may consume power.

SUMMARY

In some examples, methods for adjusting a display intensity of a display are generally described. The methods may include, by a processor, receiving display instructions. The display instructions may include instructions that relate to display of first output data. The first output data may be effective to produce a first intensity when rendered by the display. The methods may further include, by the processor, applying a technique at a first level to the display instructions to generate second output data. The second output data may be effective to produce a second intensity when rendered by the display. The second intensity may be less than the first intensity. The methods may further include, by the processor, applying the technique at a second level to the display instructions to generate third output data. The third output data may be effective to produce a third intensity when rendered by the display. The third intensity may be less than the second intensity.

In some examples, devices effective to adjust display intensity of a display are generally described. The devices may include the display, a memory, and a processor. The memory may include a display intensity adjustment algorithm and two or more display intensity adjustment techniques. The processor may be configured to be in communication with the display and the memory. The processor may be effective to receive display instructions. The display instructions may include instructions that relate to display of first output data. The first output data may be effective to produce a first intensity when rendered by the display. The processor may further be effective to, based on the display intensity adjustment algorithm, apply one of the techniques at a first level to the display instructions to generate second output data. The second output data may be effective to produce a second intensity when rendered by the display. The second intensity may be less than the first intensity. The processor may further be effective to, based on the display intensity adjustment algorithm, apply the technique at a second level to the display instructions to generate third output data. The third output data may be effective to produce a third intensity when rendered by the display. The third intensity may be less than the second intensity.

In some examples, methods for adjusting a display intensity of a display are generally described. The methods may include, by a processor, receiving display instructions. The display instructions may include instructions that relate to display of first output data. The first output data may be effective to produce a first intensity when rendered by the display. The methods may further include, by the processor, applying a first technique to the display instructions to generate second output data. The second output data may be effective to produce a second intensity when rendered by the display. The second intensity may be less than the first intensity. The methods may further include, by the processor, applying a second technique different from the first technique to the display instructions to generate third output data. The third output data may be effective to produce a third intensity when rendered by the display. The third intensity may be less than the second intensity.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
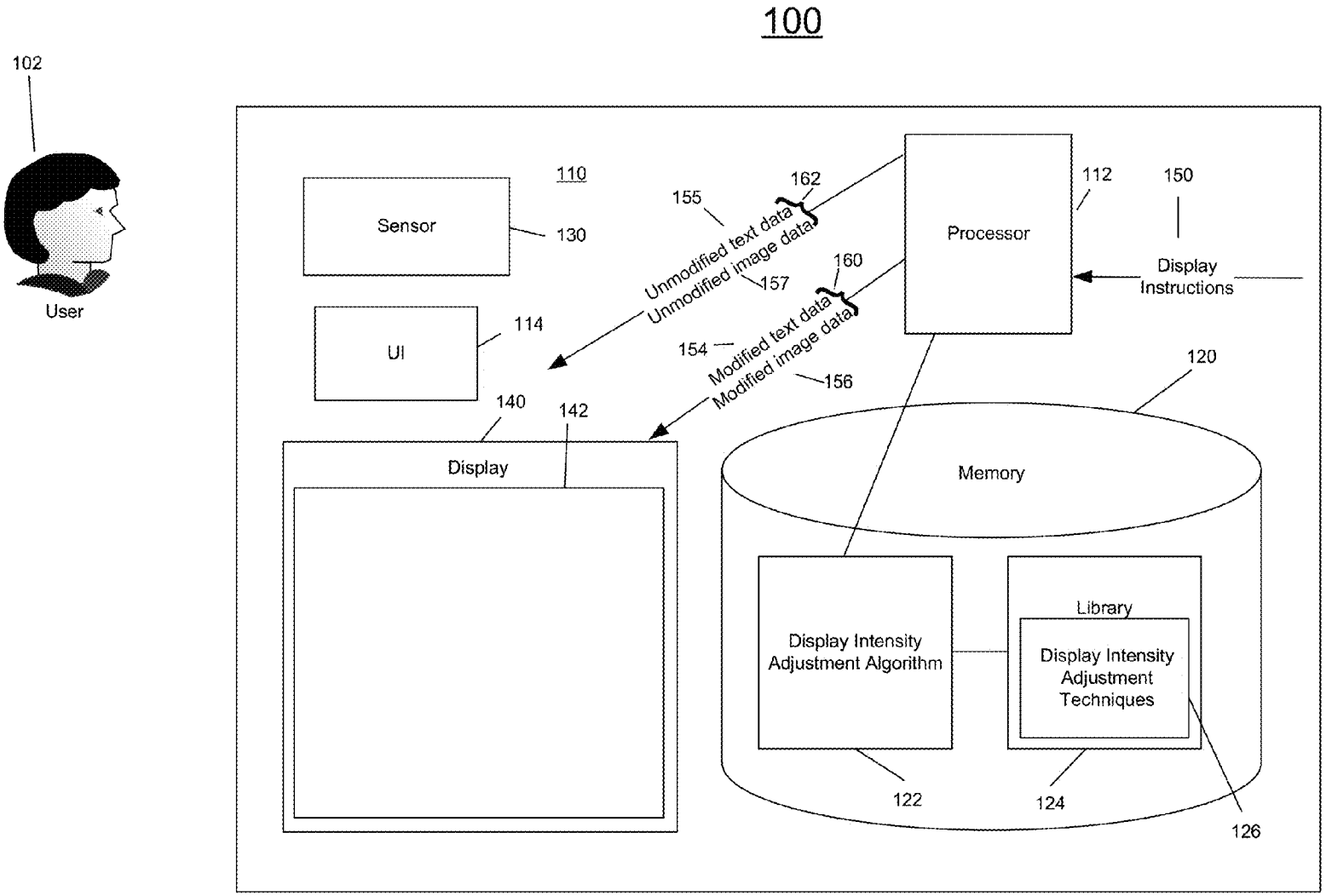
FIG. 1 illustrates an example system that can be utilized to implement adjustment of display intensity.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems, devices, and computer program products related to adjustment of display intensity.

Briefly stated, technologies, including methods and systems, effective to adjust display intensity are generally described. In some examples, a processor may receive display instructions. The display instructions may include instructions that relate to display of first output data. The first output data may be effective to produce a first intensity when rendered by a display. The processor may apply a technique at a first level to the display instructions to generate second output data. The second output data may be effective to produce a second intensity when rendered by the display. The second intensity may be less than the first intensity. The processor may apply the technique at a second level to the display instructions to generate third output data. The third output data may be effective to produce a third intensity when rendered by the display. The third intensity may be less than the second intensity.

FIG. 1 illustrates an example system that can be utilized to implement adjustment of display intensity, arranged in accordance with at least some embodiments described herein. In some examples, a system 100 may include one or more devices 110 that may be used by a user 102. Device 110 may include a processor 112, a user interface ("UI") 114, a memory 120, a sensor 130, and/or a display 140, all configured to be in communication with each other. Memory 120 may store a display intensity adjustment algorithm 122 and/or a library 124. Display intensity adjustment algorithm 122 may be implemented as software, hardware, or a combination of software and hardware. Library 124 may include one or more display intensity adjustment techniques (referred to herein as "display intensity adjustment techniques" or "techniques") 126. Display 140 may be an optical light emitting diode (OLED) display or other display where power consumption (or input power) is proportional to emitted light intensity.

User interface 114 may be used by user 102 to interact with device 110. Sensor 130 may be configured to detect parameters relating to system 100. Display 140 may be configured to render an output 142. As is more fully described below, output 142 may be any text, images, video or other output that may be rendered by display 140. Processor 112 may execute display instructions 150 and generate unmodified output data 162. Unmodified output data 162 may include unmodified text data 155 and/or unmodified image data 157. Processor 112 may further, based on display intensity adjustment algorithm 122, execute display instructions 150 to generate modified output data 162. Modified output data 162 may include modified text data 154 and/or modified image data 156. Display intensity adjustment algorithm 122 may, for example, adjust an intensity at which display 140 renders output 142 by causing processor 112 to generate modified output data 162. Display 140 may render unmodified output data 162 or modified output data 160 to generate output 142.

Figure 2:
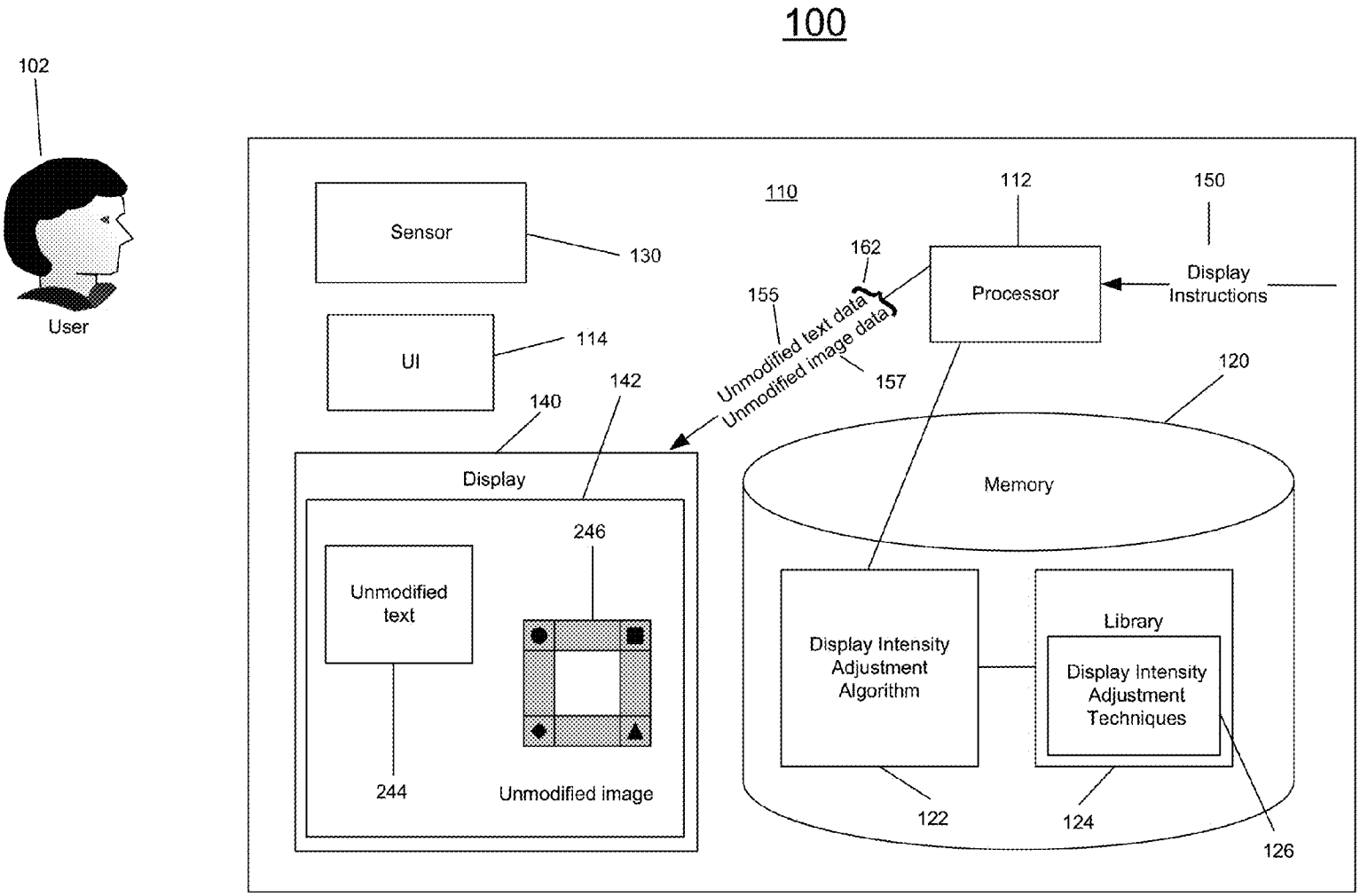
FIG. 2 illustrates the example system that can be utilized to implement adjustment of display intensity of FIG. 1 with further detail.

FIG. 2 illustrates the example system that can be utilized to implement adjustment of display intensity of FIG. 1 with further detail, arranged in accordance with at least some embodiments described herein. Those components in FIG. 2 that are labeled identically to components of FIG. 1 will not be described again for the purposes of clarity.

Display instructions 150 may be received from within device 110, such as from memory 120, or from outside device 110, such as from another device or from a network. Processor 112 may execute display instructions 150 and generate unmodified text data 155 and/or unmodified image data 157. Display 140 may render unmodified text data 155 and/or unmodified image data 157 to produce unmodified text 244 and/or an unmodified image 246. Processor 112 may control display 140 to render unmodified text 244 based on unmodified text data 155. Similarly, processor 112 may control display 140 to render unmodified image 246 based on unmodified image data 157.

Figure 3:
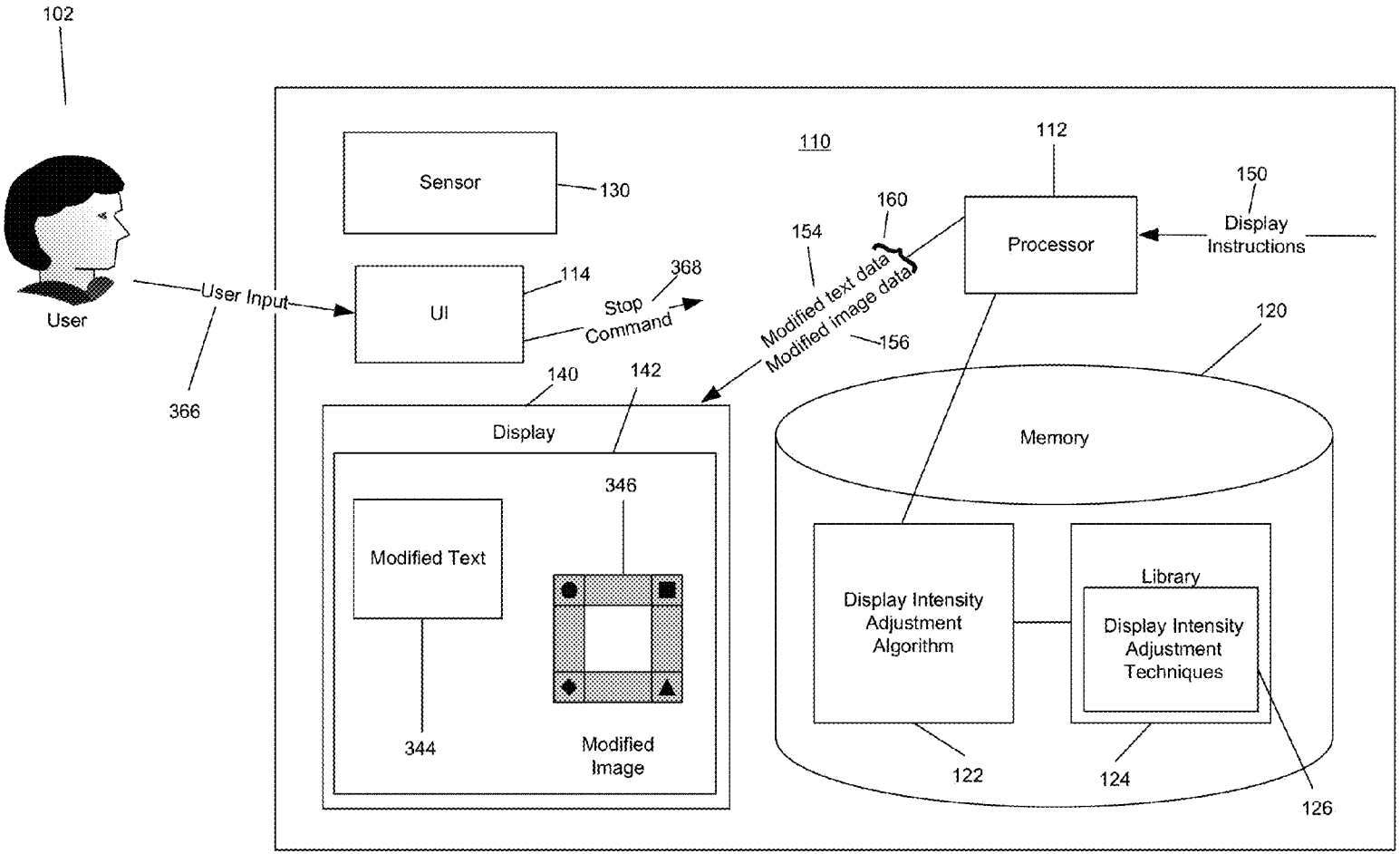
FIG. 3 illustrates the example system that can be utilized to implement adjustment of display intensity of FIG. 1 with further detail.

FIG. 3 illustrates the example system that can be utilized to implement adjustment of display intensity of FIG. 1 with further detail, arranged in accordance with at least some embodiments described herein. Those components in FIG. 3 that are labeled identically to components of FIGS. 1 and 2 will not be described again for the purposes of clarity.

Processor 112 may execute display instructions 150 based on display intensity adjustment algorithm 122 to generate modified text data 154 and/or modified image data 156. Display 140 may render modified text data 154 and/or modified image data 156 to produce modified text 344 and/or a modified image 346. As is more fully described below, execution of display instructions 150 based on display intensity adjustment algorithm 122 may result in an adjustment of an overall intensity of display 140.

Display intensity adjustment algorithm 122 may be effective to determine whether one or more display intensity adjustment techniques 126 may be suitable to be applied to display instructions 150. Display intensity adjustment algorithm 122 may also be effective to select and apply one or more display intensity adjustment techniques 126 to display instructions 150 to generate modified output data 160. Rendering modified output data 160, compared with rendering unmodified output data 162, may result in an adjustment of an amount of intensity of display 140. Thus, rendering modified output data 160 may cause display 140 to produce a different intensity than rendering unmodified output data 162. The intensity of display 140 may be, for example, a brightness, luminosity, contrast or other parameter that may decrease the amount of energy consumed by display 140.

As described in more detail below, display intensity adjustment algorithm 122 may further be effective to apply two or more display intensity adjustment techniques 126 to display instructions 150 to adjust the intensity of display 140. Display intensity adjustment algorithm 122 may be effective to apply a single display intensity adjustment technique 126 at two or more levels to display instructions 150 to adjust the intensity of display 140. Levels of display intensity adjustment techniques 126 may be, for example, changes in value of 1%, 5%, etc. or any other amount. For example, display intensity adjustment technique 126 may be applied to reduce the intensity of display 140 at a first level by 5% over a period of a few days. If user 102 does not indicate through the user interface that this change is objectionable, application of a display intensity adjustment technique 126 at a second level may, for example, further reduce the amount of intensity of display 140 by 5% over a second period of a few days, and so on resulting in a total reduction of 10% over a period of time. This interactive adjustment of levels can be repeated until the user indicates that the change in displayed image is problematic. In response, processor 112 may use one lower level and stay at that level from that point on. Display intensity adjustment algorithm 122 may try to increase the level at some later time, from weeks to months, and monitor user interface 114 see if the change is now acceptable.

Display intensity adjustment algorithm 122 may further be effective to monitor receipt of a user input 366 from user 102 through user interface 114. In response to receipt of user input 366, user interface 114 may generate a stop command 368 relating to stopping the adjustment of the amount of intensity of display 140. For example, user 102, through user interface 114, may provide user input 366 requesting processor 112 to stop application of further display intensity adjustment techniques 126, and return to the previous level before the last adjustment.

Display intensity adjustment algorithm 122 may apply one or more display intensity adjustment techniques 126, increasing the level at which the technique is applied over a period of time, until receipt of stop command 368. After receipt of stop command 368, display intensity adjustment algorithm 122 may cause control processor 112 to wait a period of time, such as a day or even several weeks. After waiting the period of time, display intensity adjustment algorithm 122 may further apply the display intensity adjustment technique 126 at one or more increased levels. The delay between applications of the display intensity adjustment technique 126 may allow user 102 to become more accustomed to the adjustments made by the display intensity adjustment technique 126.

In one example, processor 112 may receive display instructions 150. Display instructions 150 may request that processor 112 render a text document on display 140. Processor 112 may execute display instructions 150 based on display intensity adjustment algorithm 122. Display intensity adjustment algorithm 122 may apply two or more display intensity adjustment techniques 126 to display instructions 150 to generate modified text data 154 relating to the text document. Processor 112 may control display 140 to render output 142 including modified text 344. After the display intensity adjustment techniques 126 has been applied to display instructions 150 at a number of levels, user 102 may provide user input 366 through user interface 114. Based on user input 366, user interface 114 may generate stop command 368 to prevent further levels of display intensity adjustment techniques 126 from being applied to display instructions 150.

Figure 4:
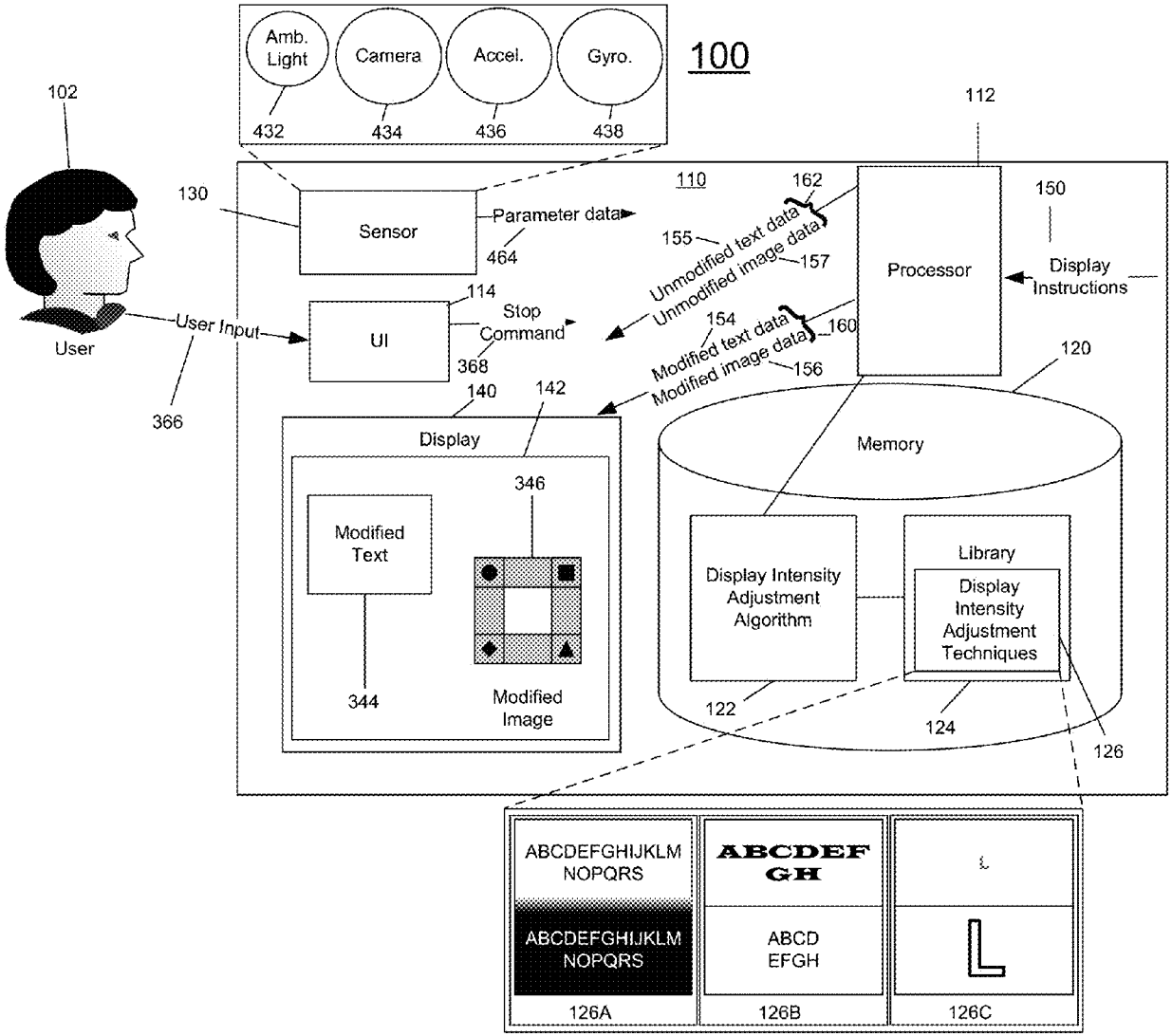
FIG. 4 illustrates the example system that can be utilized to implement adjustment of display intensity of FIG. 1 with further detail relating to display intensity adjustment techniques.

FIG. 4 illustrates the example system that can be utilized to implement adjustment of display intensity of FIG. 1 with further detail relating to display intensity adjustment techniques, arranged in accordance with at least some embodiments described herein. Those components in FIG. 4 that are labeled identically to components of FIGS. 1, 2 and 3 will not be described again for the purposes of clarity.

Sensor 130 may be one or more of an ambient light sensor 432, a camera 434 pointing either to the user's face and/or in any other direction, an accelerometer 436, and/or a gyroscope 438, or any other sensor capable of providing information which can be used for this purpose. Sensor 130 may generate parameter data 464. Display intensity adjustment techniques 126 may be based on values of parameter data 464. Parameter data 464 may be based on, for example, the amount of ambient light detected by ambient light sensor 432, images captured by camera 434, a motion of device 110 as detected by accelerometer 436 and/or gyroscope 438, etc.

Various display intensity adjustment techniques 126 may be used to, for example, adjust the intensity, color, contrast or brightness at which output 142 is rendered on display 140. Some example display intensity adjustment techniques 126 are discussed in more detail below.

One example display intensity adjustment technique 126 may examine display instructions 150 to determine whether an area of output 142 is larger than a threshold size and of the same color or in a range of the same wavelengths. For example, the threshold size of the area may cover 10% or more of display 140. The area of output 142 may be determined by algorithms such as image processing algorithms. If an area of output 142 is detected to be of the same color, display intensity adjustment technique 126 may create a gradient of intensity values varying from a relatively high value at an edge of the area to a relatively lower value towards the center of the area. In one example, the edge of the area may include 5% of the screen and intensity values may decrease by 10% for every 5% movement toward the center. Such adjustments to the intensity of the area may result in an adjustment of an overall intensity of display 140. Different levels may include decreasing intensity by different percentages. For example, a first level may decrease intensity by 2%, a second level may decrease intensity by 4%, etc.

In another example display intensity adjustment technique 126, modified output data 160 may be generated such that a negative of at least some of unmodified output data 162 is displayed when modified output data 160 is rendered. For example, black text on a white background may be displayed as white text on a black background—as shown at 126A. The edges of such black backgrounds may be adjusted to smoothly fade from black to white. In some examples, the negative of the original image may be applied to text and not to images. This technique may be considered each time a text in a high power consumption color is presented against a background of a lower power consumption color, and the total text area (number of pixels comprising letters) is smaller than the background area (number of pixels comprising background). Different levels may include activation of this technique for gradually decreasing power saving thresholds—starting with reversing small black text on large white background (maximum power saving), to reversing large light gray fonts on a dark grey background (minimal saving).

Another example display intensity adjustment technique 126 may change fonts between unmodified text data 155 and modified text data 154. For example, modified text data 154 may include a different font that uses less intensity—as shown at 126B. Different levels of this technique may include gradually changing to different types of fonts with less intensity. For example, a first level may include changing to a font that is similar in appearance to the font in unmodified text data 155 but with less intensity. A second level may include changing to a font that is less similar in appearance to the font in unmodified text data 155 but with even less intensity.

In another example display intensity adjustment technique 126, unmodified text 244 (FIG. 2) may include characters presented in fonts with bold, filled-in, characters. Such characters in unmodified text 244 may be replaced with characters that outline the edges of the characters and/or fill the inside of the character with a lower intensity color such as white—as shown at 126C. Different levels may include. Different levels may be selected based on the amount of power saving this change brings. For example, a first level may change relatively large fonts in white, where the ratio of contour to total area is very large. Subsequent levels may include changing small fonts—even if power saving is negligible, to make the display more visually appealing if larger fonts have been changed on the same screen.

In another example display intensity adjustment technique 126, modified image data 156 for a particular modified image 346 may be stored in memory 120. Such modified image 346 may be, for example, an icon. Such stored modified image data 156 may later be loaded from memory 120 to be rendered, without display intensity adjustment technique 126 being applied again. For example, a negative image of the icon may be stored. In another example, multiple options for the icon may be stored and user 102 may be provided with options on which icon he or she prefers. The different options may correspond to different levels of display intensity adjustment techniques. For example, user 102 may select an icon based on a power budget. Alternatively, the different levels may be a set of modified icons, each slightly different and providing more power saving than its predecessor, which the technique changes over a period of several weeks without the user noticing the change.

In other example display intensity adjustment technique 126, camera 434 may capture images of the face of user 102. Processor 112 may use other algorithms, such as facial recognition algorithms, to detect the eyes of user 102. For example, the size of the pupils of the eyes of user 102 may be measured to determine a pupil contraction parameter. Using the pupil contraction parameter, processor 112 may detect when the pupils of the eyes of user 102 start to contract. Based on such detection, display intensity adjustment algorithm 122 may adjust modified output data 160 to reduce an overall brightness of display 140 based on the contraction of the user's pupil. For example, in low ambient conditions, the intensity of display 140 may be lowered to a threshold, as may be detected by the size of the user's pupil. If the user's pupil is contracting, further increases in display intensity may not be needed. Different levels of this technique may correspond to reducing the intensity by different percentages.

In another example display intensity adjustment technique 126, processor 112 may determine, based on parameters detected by accelerometer 436 and/or gyroscope 438, motion data relating to device 110. The motion data may reflect whether device 110 is stationary or accelerating. If processor 112 determines device 110 is accelerating, and the amount of acceleration exceeds a threshold, display intensity adjustment technique 126 may adjust the amount of intensity of display 140. Display intensity adjustment techniques 126 may be applied based on the amount of the acceleration. A relatively larger acceleration may result in a bigger decrease to the amount of intensity of display 140. For example, if a user 102 is moving a lot, accelerometer 436 may detect a relatively large acceleration and user 102 may not be able to see much on display 140. Therefore, display intensity adjustment technique 126 may be applied to further decrease the amount of intensity of display 140. If processor 112 determines that device 110 is no longer accelerating, the amount of intensity of display 140 may be restored to the amount of intensity prior to the adjustment. Different levels of this technique may correspond to reducing the intensity by different percentages, or initiating intensity reduction at reduced accelerations or at reduced period in acceleration before initiating intensity reduction.

In other examples, display intensity adjustment technique 126 may reduce brightness in modified output data 160 based on motion data relating to motion of device 110. For example, when device 110 is used in a car, display intensity adjustment techniques 126 may control display 140 to output a relatively lower amount of intensity than when device 110 is used at a desk. In another example, if motion data identifies motion in one or more directions, such as a tremor or vibration, display intensity adjustment techniques 126 may generate modified output data 160 resulting in a reduction of intensity to full elimination relating to relatively smaller details, such as spikes in a serif type font. Increased shaking may result in the intensity being decreased for larger and larger details of a font or an image. Further increased shaking may result in the intensity of the entire display 140 being reduced. In another example, an intensity of objects smaller than a first threshold size (e.g., 10 pixels) may be reduced when a vibration is greater than a second threshold. Different levels of this technique may correspond to reducing the intensity by different percentages. Increased levels may be selected by lowering the minimal acceleration threshold at which the technique is applied, as well as increasing the minimal details size which may be eliminated when this threshold is crossed.

In another example display intensity adjustment technique 126, unmodified output data 162 may be modified such that colors of output 142 are changed to colors with a lower amount of intensity. Processor 112 may generate modified text data 154 and/or modified image data 156 so that the colors of modified text 344 and/or modified image 346 are different from the colors of unmodified text 244 (FIG. 2) and/or unmodified image 246 (FIG. 2). For example, colors with a higher amount of intensity, such as blue, may be changed to colors with a lower amount of intensity, such as green. Different levels of this technique may correspond to the difference in the reduction of the amount of intensity resulting from the changing of the colors of output 142. For example, some particular colors being changed, such as from pure blue to bluish-green may result in a 5% reduction in the amount of intensity of display 140, while other colors, such as pure blue to pure green, being changed may result in a 10% reduction, etc.

In another example display intensity adjustment technique 126, camera 434 may capture images of the face of user 102. Processor 112 may use algorithms, such as facial recognition algorithms, to determine gaze line data relating to the gaze line of the eyes of user 102. Display 140 may be divided into two or more portions, such as a focus portion and remaining portions. Based on the gaze line data, processor 112 may identify the focus portion. The focus portion may be the portion of display 140, and, correspondingly, output 142, at which user 102 is looking The remaining portions may be those portions of display 140, and, correspondingly, output 142, at which user 102 is not looking Display intensity adjustment techniques 126 may be applied to display instructions 150 to adjust the amount of intensity of output 142 on the remaining portions of display 140, while leaving the focus portion of output 142 and display 140 unadjusted. Different levels of this technique may correspond to reducing the intensity of the remaining portions by different percentages, or to increasing the area ratio between an in-focus portion to out of focus portion.

Another example display intensity adjustment technique 126 may adjust the amount of intensity of display 140 based on a distance between an object and device 110. Processor 112 may determine the distance between an object, such as user 102, and device 110 based on a distance parameter. If the object is closer than a threshold distance away from device 110, display intensity adjustment techniques 126 may reduce the amount of intensity of display 140. For example, camera 434 may capture images of the face of user 102. Processor 112 may use facial recognition algorithms to detect a location of and/or distance between the eyes of user 102, and thereby determine the distance parameter. Using the distance parameter, processor 112 may determine a distance between user 102, and device 110. Different levels of this technique may correspond to reducing the intensity of display 140 by different percentages, or by initiation of display dimming at increasing threshold distances.

Another example display intensity adjustment technique 126 may modify unmodified image data 157 to change colors that are adjacent to each other in output 142. Image processing algorithms may be used to detect adjacent colors that may be changed to increase the visibility of output 142. Such adjacent colors may be changed to other colors that have a higher amount of contrast. Higher contrast between adjacent colors may increase the visibility of output 142. Such changes to the colors of output 142 may result in an adjustment of an overall intensity of display 140, or may allow the technique to decrease the overall intensity of the display while maintaining acceptable readability. Different levels of this technique may correspond to the difference in the reduction of the amount of intensity resulting from the changing of the colors of output 142. For example, some particular colors being changed may allow a 5% reduction in the amount of intensity of display 140, while other colors being changed may allow a 10% reduction, etc.

In another example display intensity adjustment technique 126, display instructions 150 may be modified to adjust the amount of intensity of unmodified text 244 and/or unmodified images 246 that appear outside of an active portion of display 140. For example, processor 112 may determine that some portions of display 140 are more active than other portions of display 140. Such determination may be based on, for example, the frequency at which output 142 is being rendered on a particular portion of display 140. The amount of intensity at which output 142 is rendered on the other less active portions of display 140 may be reduced, while leaving the active portion unadjusted. Such reduction in the amount of intensity of the other portions of display 140 may result in a reduction of the overall intensity of display 140. Different levels of this technique may correspond to reducing the intensity of the other portions by different percentages, or setting lower thresholds of activity in the active portions of the display to initiate the process.

In one example, processor 112 may receive display instructions 150 to render a text document on display 140. Processor 112 may use display intensity adjustment algorithm 122 to execute display instructions 150. Display intensity adjustment algorithm 122 may apply a particular display intensity adjustment technique 126 which modifies the font in which text is rendered on display 140. Using the particular display intensity adjustment technique 126, display intensity adjustment algorithm 122 may modify display instructions 150 to generate modified text data 154 relating to the text document. Modified text data 154 may effectively modify the font in which text is rendered on display 140. Processor 112 may control display 140 to render output 142. Output 142 may include the text document using the modified font.

In another example, processor 112 may receive display instructions 150 to render a particular image on display 140. Processor 112 may use display intensity adjustment algorithm 122 to execute display instructions 150. Display intensity adjustment algorithm 122 may apply a particular display intensity adjustment technique 126 which adjusts the colors of the particular image. Using the particular display intensity adjustment technique 126, display intensity adjustment algorithm 122 may modify display instructions 150 to generate modified image data 156 relating to the particular image. The modified image data 156 may effectively adjust the colors of the particular image when the particular image is rendered on display 140. Processor 112 may control display 140 to render output 142. Output 142 may include the particular image with adjusted colors.

In another example, display intensity adjustment technique 126 may decrease of display intensity in areas blocked from a user's view. For example, processor 112 may detect contact areas of user interface 114 that are being touched by a user's fingers. Processor 112 may reduce an intensity of an area under the contact points, and under a buffer zone around the areas, to a relatively high degree. Based on an orientation of device 110, processor 112 may reduce an intensity of areas below the contact areas which are under the fingers but not being touched, to a relatively lesser degree. This technique may be particularly effective with multi-contact games where the user's fingers may be touching the display almost continuously.

Display intensity adjustment algorithm 122 may select one or more display intensity adjustment techniques 126 in a variety of ways. In one example, techniques may be selected in an order so that subsequent techniques benefit from application of prior techniques. In another example, display intensity adjustment algorithm 122 may select one or more display intensity adjustment techniques 126 based on parameters received from sensor 130. For example, if processor 112 determines that the eyes of user 102 are relatively close to device 110 based on parameter data 464, display intensity adjustment algorithm 122 may select a display intensity adjustment technique 126 based on distances between the user's eyes and device 110. Similarly, if processor 112 determines that device 110 is shaking, display intensity adjustment algorithm 122 may select a display intensity adjustment technique 126 that reduces intensity based on motion data.

Display intensity adjustment algorithm 122 may increase a level of a display intensity adjustment technique 126, such as reducing the brightness of display 140, until receipt of user input 366 from the user 102 through user interface 114. After receiving the user input 366, user interface 114 may generate a stop command 368. Display intensity adjustment algorithm 122 may process stop command 368 and stop applying further levels of display intensity adjustment techniques 126, or return to the previous level of adjustment using the technique last applied. Display intensity adjustment algorithm 122 may further increase a level of the display intensity adjustment technique 126 after waiting a period of time, such as ranging between a day to several weeks, so that the user may become more accustomed to modified images.

Display intensity adjustment algorithm 122 may generate an intensity reduction grade for at least some of display intensity adjustment techniques 126. The intensity reduction grades may indicate how much a technique affects an image. This grade may represent a numerical, validated measure of the degree of change perceived by the average user, also accounting for the "feel" of the change, as some changes may be perceived as more disturbing or more image distorting than others. A second "user convenience" grade may be calculated to indicate how much intensity reduction may be achieved using the typical use profile of the current user. Display intensity adjustment techniques 126 may be ordered by intensity reduction grade and user convenience grade to apply intensity reduction techniques in an order from most effective, meaning highest intensity reduction with lowest user inconvenience, to less effective.

In another example, processor 112 may receive display instructions 150 to render a particular image on display 140. Processor 112 may use display intensity adjustment algorithm 122 to execute display instructions 150. Display intensity adjustment algorithm 122 may apply a particular display intensity adjustment technique 126 based on an application being rendered on display 140. Display intensity adjustment algorithm 122 may select a display intensity adjustment technique 126 based on whether the application is sensitive to changes. In the example, a reading application may be more sensitive to changes in motion, such as shaking or vibration making the text unreadable, and this sensitivity increases with decreasing text size. If such motion is detected, processor 112 may apply one or more display intensity adjustment techniques 126 to adjust the intensity at which unmodified text 244 is rendered by display 140 to minimize text display energy consumption when text is not readable for other reasons.

Figure 5:
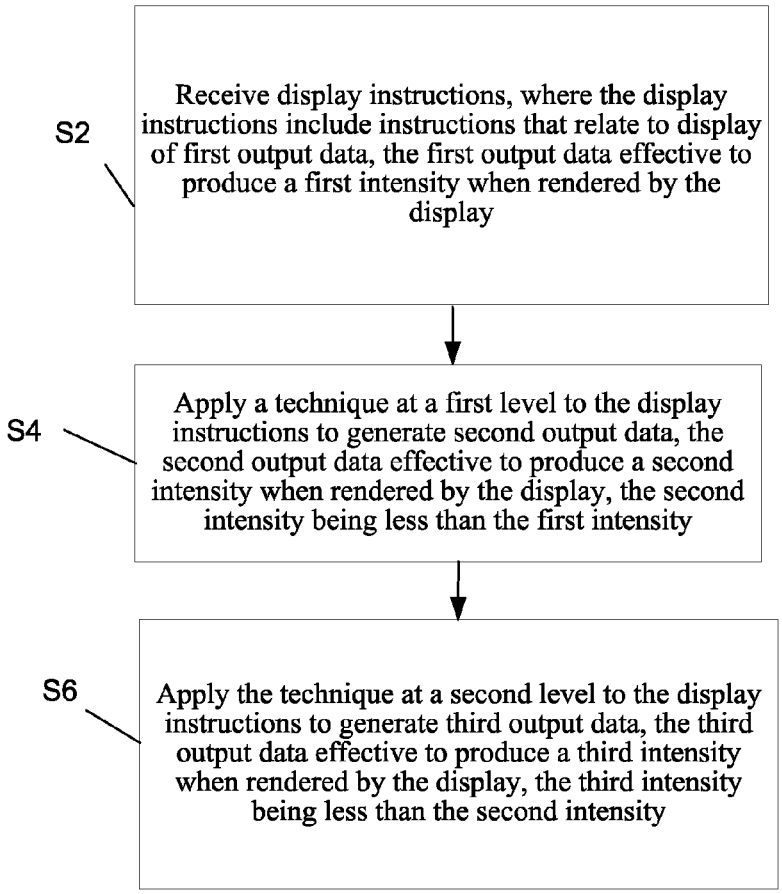
FIG. 5 depicts a flow diagram for an example process for implementing adjustment of display intensity.

FIG. 5 depicts a flow diagram for example processes for implementing adjustment of display intensity, arranged in accordance with at least some embodiments described herein. In some examples, the process in FIG. 5 could be implemented using, for example, system 100 discussed above.

An example process of a method for adjusting a display intensity of a display may include one or more operations, actions, or functions as illustrated by one or more of blocks S2, S4, and/or S6. Although illustrated as discrete blocks, various blocks may be divided into additional blocks, combined into fewer blocks, or eliminated, depending on the desired implementation.

Processing may begin at block S2, "Receive display instructions, where the display instructions include instructions that relate to display of first output data, the first output data effective to produce a first intensity when rendered by the display." At block S2, a processor may receive display instructions. The display instructions may include instructions that relate to display of first output data. The first output data may be effective to produce a first intensity when rendered by the display.

Processing may continue from block S2 to block S4, "Apply a technique at a first level to the display instructions to generate second output data, the second output data effective to produce a second intensity when rendered by the display, the second intensity being less than the first intensity." At block S4, the processor may apply a technique at a first level to the display instructions to generate second output data effective to produce a second intensity when rendered by the display. The second intensity may be less than the first intensity.

In one example, the first output data may relate to a first font or first color, and the second output data may relate to a second font or second color different from the first font or first color. In an example, the processor may determine gaze line data and identify a focus portion and remaining portion of the display corresponding to the gaze line data. The processor may generate the second output so that the remaining portion is rendered with less intensity than the focus portion. In an example, the processor may identify an area in the first output data that, when rendered, includes a single color and apply a technique at a first level to generate second output data so that the area is rendered with a gradient of intensity values.

In one example, the processor may generate the second output data so that a negative of at least some of a render of the first output data is displayed when the second output data is rendered. In an example, the processor may determine a distance parameter based on a distance between the display and an object, and generate the second output data based on the distance parameter. The processor may determine a pupil contraction parameter and generate the second output data based on the pupil contraction parameter. The processor may determine motion data that relates to a motion of the display and generate the second output data based on the motion data.

Processing may continue from block S4 to block S6, "Apply the technique at a second level to the display instructions to generate third output data, the third output data effective to produce a third intensity when rendered by the display, the third intensity being less than the second intensity." At block S6, the processor may apply the technique at a second level to the display instructions to generate third output data, effective to produce a third intensity when rendered by the display. The third intensity by may be less than the second intensity.

The processor may gradually increase levels of the technique over time to the display instructions until receipt of a stop command. Each subsequent level may produce a respective output data that, when rendered by the display, produces less intensity than a prior level. Following receipt of the stop command, the processor may return to the previous level, and wait a period of time. The processor may the try to re-apply the technique at a third level of intensity to the display instructions to generate fourth output data effective to produce a fourth intensity when rendered by the display. The fourth intensity may be less than the third intensity.

The processor may select a second technique, different from the first technique, to apply to the display instructions. The processor may apply the second technique to the display instructions to produce fourth output data with an intensity different from the first and second intensity.

Figure 6:
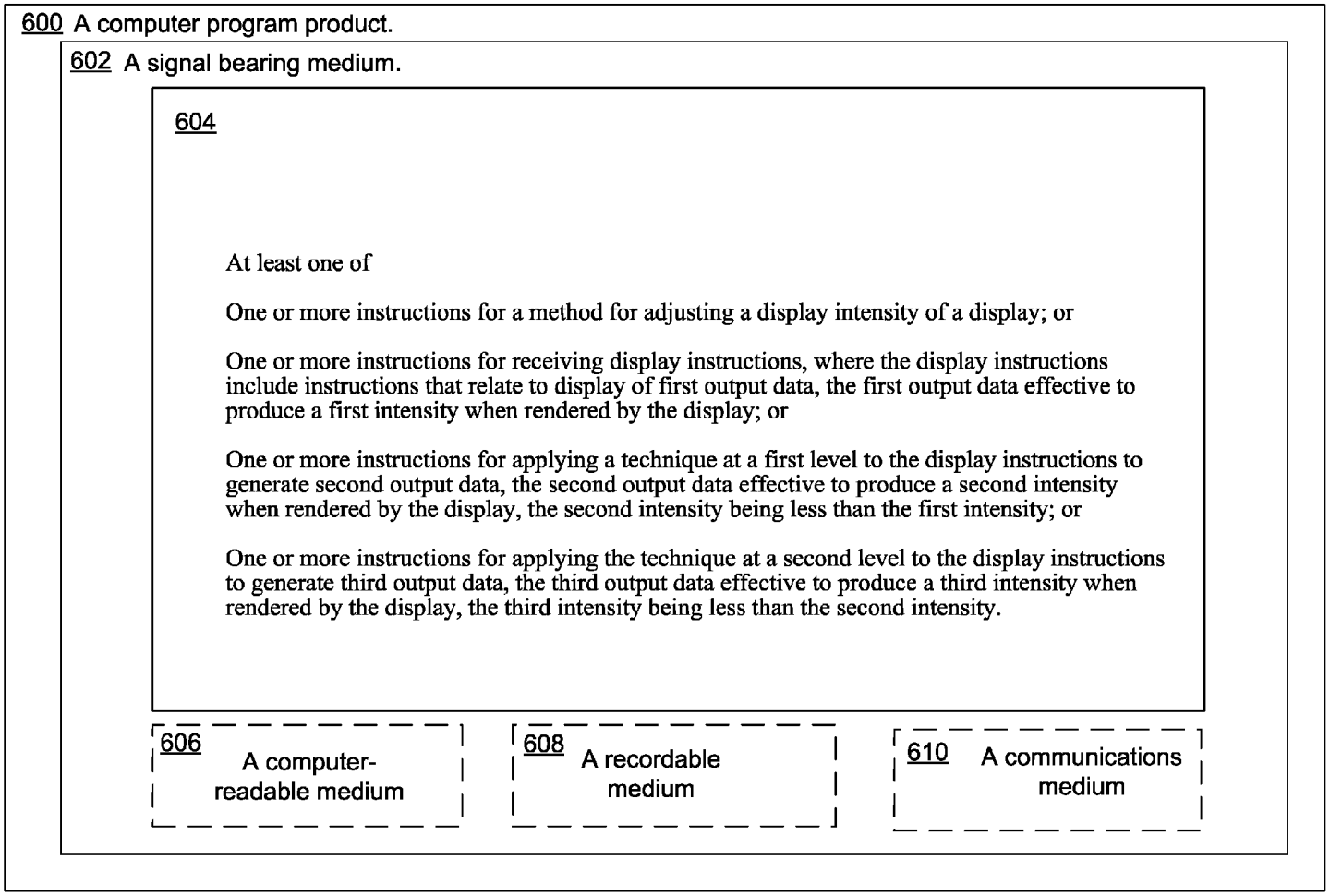
FIG. 6 illustrates a computer program product that can be utilized to implement adjustment of display intensity.

FIG. 6 illustrates an example computer program product 600 that can be utilized to implement adjustment of display intensity, arranged in accordance with at least some embodiments described herein. Computer program product 600 may include a signal bearing medium 602. Signal bearing medium 602 may include one or more instructions 604 that, when executed by, for example, a processor, may provide the functionality described above with respect to FIGS. 1-5. Thus, for example, referring to system 100, processor 112 may undertake one or more of the blocks shown in FIG. 5 in response to instructions 604 conveyed to the system 100 by signal bearing medium 602.

In some implementations, signal bearing medium 602 may encompass a computer-readable medium 606, such as, but not limited to, a hard disk drive, a Compact Disc (CD), a Digital Video Disk (DVD), a digital tape, memory, etc. In some implementations, signal bearing medium 602 may encompass a recordable medium 608, such as, but not limited to, memory, read/write (R/W) CDs, R/W DVDs, etc. In some implementations, signal bearing medium 602 may encompass a communications medium 610, such as, but not limited to, a digital and/or an analog communication medium (e.g., a fiber optic cable, a waveguide, a wired communications link, a wireless communication link, etc.). Thus, for example, computer program product 600 may be conveyed to processor 112 by an RF signal bearing medium 602, where the signal bearing medium 602 is conveyed by a wireless communications medium 610 (e.g., a wireless communications medium conforming with the IEEE 802.11 standard).

Figure 7:
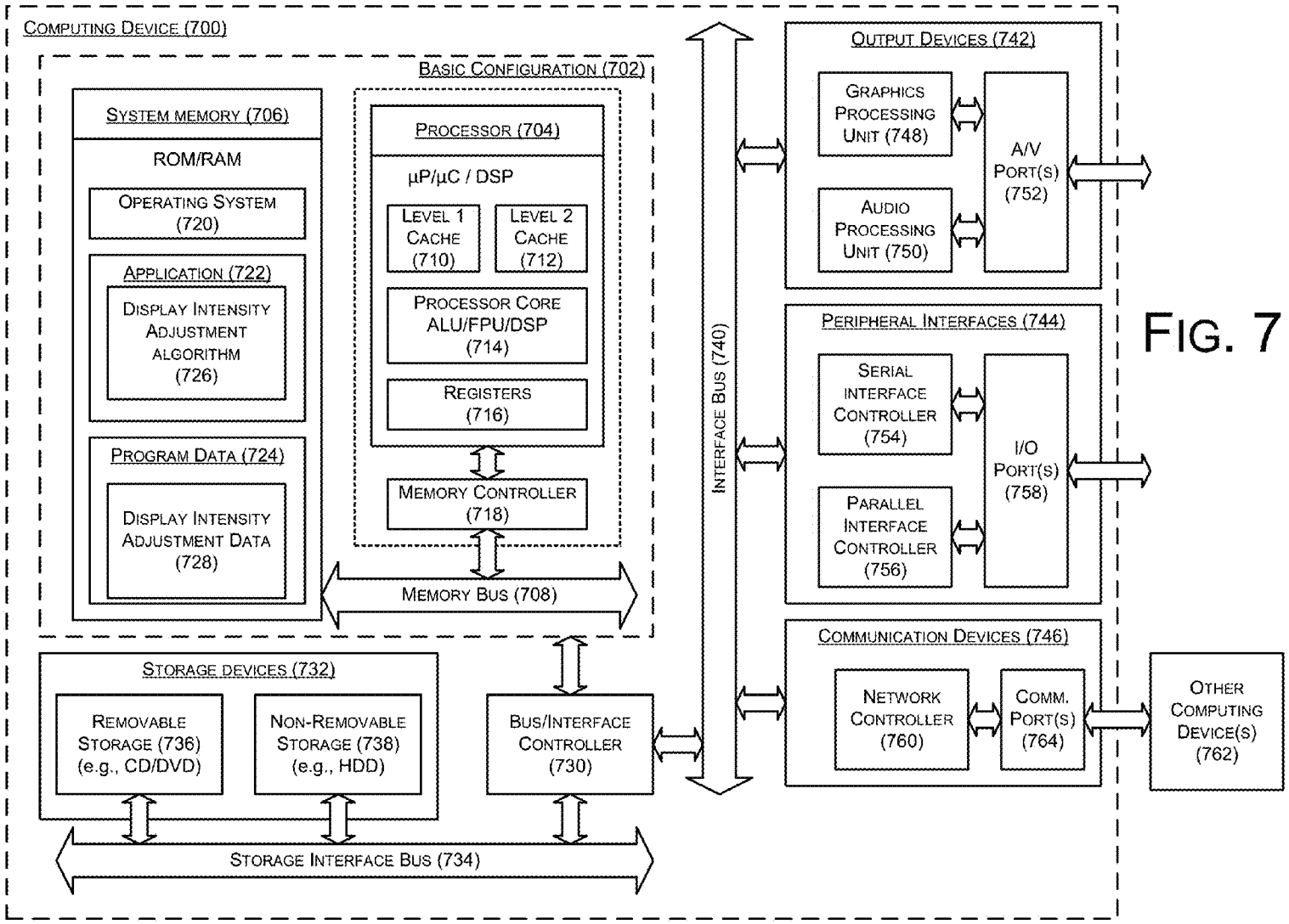
FIG. 7 is a block diagram illustrating an example computing device that is arranged to implement adjustment of display intensity, all arranged in accordance with at least some embodiments described herein.

FIG. 7 is a block diagram illustrating an example computing device 700 that is arranged to implement adjustment of display intensity, arranged in accordance with at least some embodiments described herein. In a very basic configuration 702, computing device 700 typically includes one or more processors 704 and a system memory 706. A memory bus 708 may be used for communicating between processor 704 and system memory 706.

Depending on the desired configuration, processor 704 may be of any type including but not limited to a microprocessor (μP), a microcontroller (μC), a digital signal processor (DSP), or any combination thereof. Processor 704 may include one more levels of caching, such as a level one cache 710 and a level two cache 712, a processor core 714, and registers 716. An example processor core 714 may include an arithmetic logic unit (ALU), a floating point unit (FPU), a digital signal processing core (DSP Core), or any combination thereof. An example memory controller 718 may also be used with processor 704, or in some implementations memory controller 718 may be an internal part of processor 704.

Depending on the desired configuration, system memory 706 may be of any type including but not limited to volatile memory (such as RAM), non-volatile memory (such as ROM, flash memory, etc.) or any combination thereof. System memory 706 may include an operating system 720, one or more applications 722, and program data 724. Application 722 may include a display intensity adjustment algorithm 726 that is arranged to perform the functions as described herein including those described with respect to system 100 of FIG. 1. Program data 724 may include display intensity adjustment data 728 that may be useful to implement adjustment of display intensity, as is described herein. In some embodiments, application 722 may be arranged to operate with program data 724 on operating system 720 such that adjusting of display intensity may be provided. This described basic configuration 702 is illustrated in FIG. 7 by those components within the inner dashed line.

Computing device 700 may have additional features or functionality, and additional interfaces to facilitate communications between basic configuration 702 and any required devices and interfaces. For example, a bus/interface controller 730 may be used to facilitate communications between basic configuration 702 and one or more data storage devices 732 via a storage interface bus 734. Data storage devices 732 may be removable storage devices 736, non-removable storage devices 738, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 706, removable storage devices 736 and non-removable storage devices 738 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 700. Any such computer storage media may be part of computing device 700.

Computing device 700 may also include an interface bus 740 for facilitating communication from various interface devices (e.g., output devices 742, peripheral interfaces 744, and communication devices 746) to basic configuration 702 via bus/interface controller 730. Example output devices 742 include a graphics processing unit 748 and an audio processing unit 750, which may be configured to communicate to various external devices such as a display or speakers via one or more A/V ports 752. Example peripheral interfaces 744 include a serial interface controller 754 or a parallel interface controller 756, which may be configured to communicate with external devices such as input devices (e.g., keyboard, mouse, pen, voice input device, touch input device, etc.) or other peripheral devices (e.g., printer, scanner, etc.) via one or more I/O ports 758. An example communication device 746 includes a network controller 760, which may be arranged to facilitate communications with one or more other computing devices 762 over a network communication link via one or more communication ports 764.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 700 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 700 may also be implemented as a personal computer including both laptop computer and non-laptop computer configurations.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method to adjust a display intensity of a display, the method comprising:

receiving, by a processor, display instructions, where the display instructions include instructions that relate to display of first output data, the first output data effective to produce a first intensity when rendered by the display;

based on a display intensity adjustment algorithm, applying, by the processor, a technique at a first level to the display instructions to generate second output data, the second output data effective to produce a second intensity when rendered by the display, the second intensity being less than the first intensity;

sending, by the processor, the second output data to the display;

determining, by the processor, that a period of time has passed;

in response to the determination that the period of time has passed, based on the display intensity adjustment algorithm, applying, by the processor, the technique at a second level to the display instructions to generate third output data, the third output data effective to produce a third intensity when rendered by the display, the third intensity being less than the second intensity;

sending, by the processor, the third output data to the display;

based on the display intensity adjustment algorithm, applying, by the processor, the technique at subsequent levels to generate further output data until receipt of a stop command;

in response to the receipt of the stop command, generating, by the processor, fourth output data, the fourth output data effective to produce a fourth intensity when rendered by the display, wherein the fourth intensity is less than the first intensity; and sending, by the processor, the fourth output data to the display.

2. The method of claim 1, wherein the technique is a first technique and the method further comprises:

in response to the receipt of the stop command, based on the display intensity adjustment algorithm, selecting, by the processor, a second technique to apply to the display instructions, where the second technique is different from the first technique; and based on the display intensity adjustment algorithm, applying, by the processor, the second technique to the display instructions to generate the fourth output data, and the fourth intensity is different from the second intensity.

3. The method of claim 1, wherein each subsequent level produces a respective output data that, when rendered by the display, produces less intensity than a prior level.

4. The method of claim 1, wherein the period of time is a first period of time, further comprising, after applying the technique at the second level:

receiving, by the processor, the stop command;

waiting, by the processor, a second period of time; and based on the display intensity adjustment algorithm, applying, by the processor, the technique at a third level to the display instructions to generate the fourth output data, the fourth intensity being less than the third intensity.

5. The method of claim 1, wherein:

the first output data relate to a first font; and the second output data relate to a second font different from the first font.

6. The method of claim 1, wherein:

the first output data relate to a first color; and the second output data relate to a second color different from the first color.

7. The method of claim 1, wherein applying the technique at the first level includes:

determining, by the processor, gaze line data;

identifying, by the processor, a focus portion of the display corresponding to the gaze line data;

identifying, by the processor, a remaining portion of the display based on the gaze line data; and generating, by the processor, the second output data so that the remaining portion is rendered with less intensity than the focus portion.

8. The method of claim 1, further comprising:

identifying, by the processor, an area in the first output data that, when rendered, includes a single color; and wherein applying, by the processor, the technique at the first level includes generating the second output data so that the area is rendered with a gradient of intensity values.

9. The method of claim 1, wherein applying the technique at the first level includes generating, by the processor, the second output data so that a negative of at least some of a render of the first output data is displayed when the second output data is rendered.

10. The method of claim 1, further comprising:

determining, by the processor, a distance parameter based on a distance between the display and an object; and generating, by the processor, the second output data based on the distance parameter.

11. The method of claim 1, further comprising:

determining, by the processor, a pupil contraction parameter; and generating, by the processor, the second output data based on the pupil contraction parameter.

12. The method of claim 1, further comprising:

determining, by the processor, motion data that relate to a motion of the display; and generating, by the processor, the second output data based on the motion data.

13. The method of claim 1, further comprising:

detecting, by the processor, contact areas of a user interface in communication with the display; and generating, by the processor, the second output data based on the detected contact areas.

14. A device effective to adjust a display intensity of a display, the device comprising:

the display;

a memory that includes a display intensity adjustment algorithm and two or more display intensity adjustment techniques; and a processor configured to be in communication with the display and the memory, the processor effective to:

receive display instructions, where the display instructions include instructions that relate to display of first output data, the first output data effective to produce a first intensity when rendered by the display;

based on the display intensity adjustment algorithm, apply one of the techniques at a first level to the display instructions to generate second output data, the second output data effective to produce a second intensity when rendered by the display, the second intensity being less than the first intensity;

send the second output data to the display;

determine that a period of time has passed;

in response to the determination that the period of time has passed, based on the display intensity adjustment algorithm, apply the technique at a second level to the display instructions to generate third output data, the third output data effective to produce a third intensity when rendered by the display, the third intensity being less than the second intensity;

send the third output data to the display;

apply the technique at subsequent levels to generate further output data until receipt of a stop command;

in response to the receipt of the stop command, generate fourth output data, the fourth output data effective to produce a fourth intensity when rendered by the display, wherein the fourth intensity is less than the first intensity; and send the fourth output data to the display.

15. The device of claim 14, wherein the technique is a first technique and the processor is further effective to, based on the display intensity adjustment algorithm:

select a second technique to apply to the display instructions, where the second technique is different from the first technique; and apply the second technique to the display instructions to produce the fourth output data, wherein the fourth intensity is different from the second intensity.

16. The device of claim 14, wherein the period of time is a first period of time, and wherein the processor is effective to, after application of the technique at the second level:

receive the stop command;

wait a second period of time; and apply the technique at a third level to the display instructions to generate the fourth output data, the fourth intensity being less than the third intensity.

17. The device of claim 14, wherein the processor is further effective to:

identify an area in the first output data that, when rendered, includes a single color; and generate the second output data so that the area is rendered with a gradient of intensity values.

18. A method to adjust a display intensity of a display, the method comprising:

receiving, by a processor, display instructions, where the display instructions include instructions that relate to display of first output data, the first output data effective to produce a first intensity when rendered by the display;

based on a display intensity adjustment algorithm, applying, by the processor, a first technique to the display instructions to generate second output data, the second output data effective to produce a second intensity when rendered by the display, the second intensity being less than the first intensity;

sending, by the processor, the second output data to the display;

determining, by the processor, that a period of time has passed;

in response to the determination that the period of time has passed, based on the display intensity adjustment algorithm, applying, by the processor, a second technique different from the first technique to the display instructions to generate third output data, the third output data effective to produce a third intensity when rendered by the display, the third intensity being less than the second intensity;

sending, by the processor, the third output data to the display;

based on the display intensity adjustment algorithm, applying, by the processor, subsequent techniques to generate further output data until receipt of a stop command;

in response to the receipt of the stop command, generating, by the processor, fourth output data, the fourth output data effective to produce a fourth intensity when rendered by the display, wherein the fourth intensity is less than the first intensity; and sending, by the processor, the fourth output data to the display.

19. The method of claim 18, wherein:

the second technique is applied after the first technique;

the first technique has a first intensity reduction grade indicative of an intensity reduction between the first output data and the second output data;

the second technique has a second intensity reduction grade indicative of an intensity reduction between the second output data and the third output data; and the second grade is less than the first grade.

20. The method of claim 19, wherein the first and second intensity reduction grades are based on an application being rendered by the display.

* * * * *